US005200769A

United States Patent [19]

Takemura et al.

[11] Patent Number: 5,200,769

[45] Date of Patent: Apr. 6, 1993

[54] IMAGE FORMING APPARATUS PROVIDED WITH SHIFTING MEANS FOR THE TONER FEED MEANS

[75] Inventors: Osamu Takemura, Nishinomiya; Yoshihiro Koyama, Osaka, both of Japan

[73] Assignee: Mita Industrial Co., Ltd., Osaka, Japan

[21] Appl. No.: 796,755

[22] Filed: Nov. 25, 1991

[30] Foreign Application Priority Data

Nov. 26, 1990 [JP] Japan ..... 2-324389

[51] Int. Cl.[5] ..... B41J 2/415

[52] U.S. Cl. ..... 346/140 R; 346/159

[58] Field of Search ..... 346/140 R, 159, 139 R; 400/59, 120 HE

[56] References Cited

U.S. PATENT DOCUMENTS 4,595,936 6/1986 Nakajima et al. ..... 346/139 R

FOREIGN PATENT DOCUMENTS 0410738 1/1991 European Pat. Off. .

0225775 11/1985 Japan ..... 400/120 HE 0287568 11/1990 Japan .

*Primary Examiner*—Benjamin R. Fuller

*Assistant Examiner*—Alrick Bobb

*Attorney, Agent, or Firm*—Renner, Otto, Boisselle & Sklar

[57] ABSTRACT

An image forming apparatus comprising a pair of electrodes disposed on the opposite surfaces of a substrate having a plurality of toner passages in such a manner that an electric field can be formed inside each of the toner passages so as to allow charged toner to pass therethrough. The charged toner is fed on one electrode by means of a toner feed member. The toner feed member is moved away from the toner passages by means of a shifting member when an image forming operation is not performed.

6 Claims, 3 Drawing Sheets

IMAGE FORMING APPARATUS PROVIDED WITH SHIFTING MEANS FOR THE TONER FEED MEANS

BACKGROUND OF THE INVENTION

1. Field of the Invention

The present invention relates to an image forming apparatus using powder toner.

2. Description of the Prior Art

It is known to employ an image forming method using an ink-jet printer for word processors, facsimile machines, computers, and the like.

The ink-jet printer is a typical example of a nonimpact printer, where pressure is applied to a prescribed liquid ink while a piezoelectric element or the like applies ultrasonic vibration thereto, so that the liquid ink is spurted from an ink nozzle into a prescribed electric field. The ink particles are controlled by the electric field and made to adhere to a recording sheet to form an image thereon. Such an ink-jet printing has the advantage of being able to form a clear image without generating noise during the formation of the image. On the other hand, this method is disadvantageous in that it requires the use of a special kind of recording sheet with its surface appropriately treated so as to control the rate at which the ink filters into the recording sheet. Further, the nozzle through which the ink is supplied tends to become clogged with foreign substances or the like contained in the ink.

To overcome the above difficulties with the ink-jet printer, Japanese Laid-Open Patent Publication No. 60-263962, for example, discloses an image forming apparatus using powder toner as an image forming medium. This image forming apparatus is equipped with a toner control means which controls the passing of toner particles through a toner passage in the form of a pinhole by an electrostatic attraction generated in accordance with image output signals. Through this toner control means, the toner particles are selectively fed onto a recording sheet, thereby forming a prescribed image on the recording sheet.

In such an image forming apparatus, a sheet of plane paper without surface treatment can be used as the recording sheet. Further, since the powder toner in the form of fine particles is used, the toner passage is prevented from becoming clogged with the toner.

The toner control means comprises an insulating substrate with a number of pinhole-shaped toner passages formed therethrough and a pair of electrodes sandwiching the insulating substrate so that an electric field is formed inside each of the toner passages. The pair of electrodes also have holes extending therethrough, respectively, each having the same size as that of the toner passage. The electrodes are disposed on the opposite surfaces of the insulating substrate, respectively, in such a manner that each hole is aligned with the corresponding toner passage. A prescribed voltage is applied between the pair of electrodes to form an electric field in a prescribed direction inside each toner passage, thereby allowing toner particles to pass through the toner passage. On the contrary, when it is required for toner particles not to pass through the toner passage, an electric field in the direction opposite to the above direction can be formed by applying a prescribed voltage between the electrodes.

A base electrode is disposed downstream in the toner passing direction with respect to the toner control means (on the recording sheet supply side). The recording sheet is placed on the base electrode. A prescribed potential difference is produced between the base electrode and the electrode disposed on the toner feed side of the toner control means to form an electric field therebetween, so as to ensure that the toner moves toward the recording sheet.

In the image forming apparatus as described above, a dot is formed by the toner which has passed through each toner passage, and a group of dots form an image such as a letter. The toner passages are generally disposed in a line perpendicular to the direction of the conveyance of the recording sheet. A voltage signal as a control signal is input to the pair of electrodes of the toner control means to control the formation of the image.

In the above image forming apparatus, a fixed amount of toner is fed onto one electrode disposed on the insulating substrate by means of a toner feed roller. The toner feed roller may be in contact with or in close proximity to the electrode. Thus, the toner is present on the electrode not only when an image is formed but also when an image is not formed. As a result, the toner may enter the toner passages when an image is not formed, thereby causing clogging of the toner passages.

The objective of this invention is to solve the above-described prior art problem and to provide an image forming apparatus in which toner does not enter into the toner passages when an image is not formed so as to prevent the toner passages from clogging with the toner.

SUMMARY OF THE INVENTION

The image forming apparatus of this invention, which overcomes the above-discussed and numerous other disadvantages and deficiencies of the prior art, comprises a substrate having a plurality of toner passages extending therethrough, a pair of electrodes, each having holes extending therethrough and communicating with the corresponding toner passages of the substrate, the electrodes sandwiching the substrate as an insulation and being disposed so that each hole of each electrode is aligned with the corresponding toner passage, a toner feed means disposed above one electrode for feeding charged toner, a shifting means for moving the toner feed means toward or away from the toner passages in the substrate, and an image information generating means for giving a prescribed potential between the pair of electrodes so that an electric field which causes the charged toner to pass through the toner passages is formed inside the toner passages.

In a preferred embodiment, the shifting means moves the toner feed means toward or away from the substrate.

In a preferred embodiment, the shifting means moves the toner feed means along the substrate.

In a preferred embodiment, a nozzle section is further provided which faces the toner passages when the toner feed means is moved away from the toner passages of the substrate by the shifting means, so that air is spurted out from the nozzle section.

In a preferred embodiment, a plurality of toner feed means are disposed rotatably around a support axis, so that each of the toner feed means faces the toner passages of the substrate as they rotate.

In a preferred embodiment, four toner feed means are provided for feeding magenta, cyan, yellow, and black toners, respectively.

In the image forming apparatus of the present invention, an image forming operation is performed only when the toner feed roller faces the toner passage of the substrate. The toner fed on one electrode by the toner feed means passes through the toner passages of the substrate in accordance with image signals sent from the image information generating means. When an image forming operation is not performed, the toner feed means is moved away from the toner passage by the shifting means, preventing the toner from falling into the toner passage.

As a result, it is ensured that at an image forming operation the toner is fed to the toner passages and that when an image forming operation is not performed the toner is not fed to the toner passages. Thus, the present invention makes possible the objective of providing an image forming apparatus which is free from clogging of the toner passage with the toner.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENT

Example 1

Figure 1:
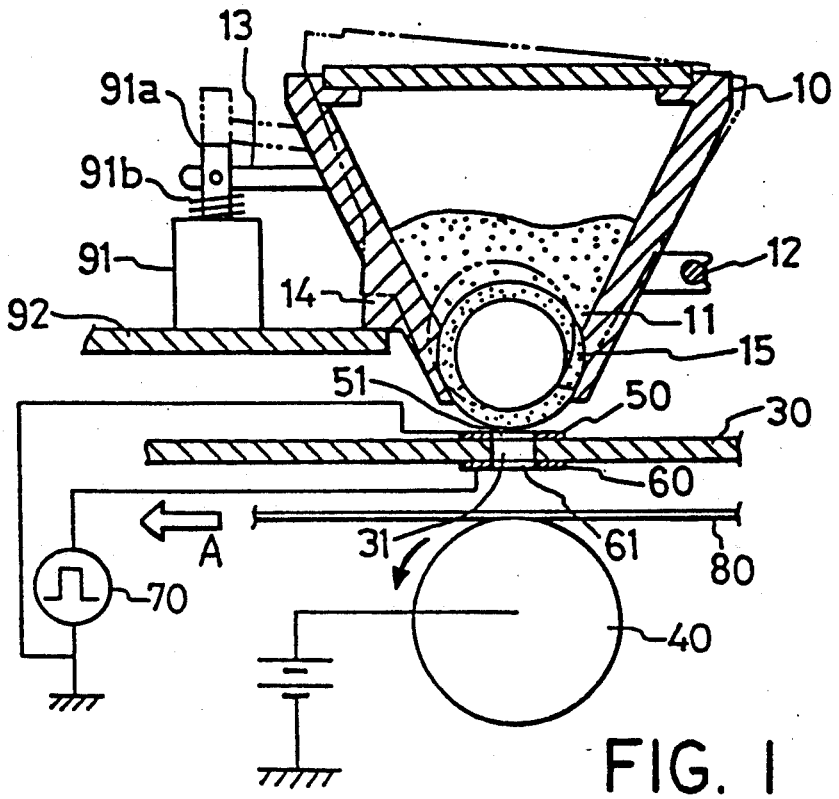
FIG. 1 is a sectional view showing an example of an image forming apparatus according to the present invention.

Referring to FIG. 1, an image forming apparatus of the present invention comprises an insulating substrate 30 having a number of toner passages 31 in the form of pinholes punctured in a line.

On the top surface of the insulating substrate 30 is disposed a common electrode 50 having a number of holes 51 vertically extending therethrough. Each hole 51 has the same size as that of the toner passage 31. The common electrode 50 is mounted on the insulating substrate 30 so that each hole 51 is aligned with the corresponding toner passage 31.

On the bottom surface of the insulating substrate 30 is disposed signal electrodes 60 each having a hole 61 of the same size as that of the toner passage 31. Each signal electrode encircles the bottom opening of the corresponding toner passage 31, and the hole 61 is aligned with the toner passage 31. The two signal electrodes 60 placed around the adjacent toner passages 31 are not in contact with each other.

The common electrode 50 is grounded. The signal electrodes 60 are connected to an image information generating unit 70, from which electric signals are sent to each of the signal electrodes 60. The image information generating unit 70 operates in response to signals sent from a machine body such as a word processor, a facsimile machine, or a computer and generates electric signals in accordance with the image information. Each of the signal electrodes 60 receive a prescribed potential in accordance with the image information; for example, when non-image forming information is to be sent, a prescribed negative potential is applied to the signal electrode 60, and when image forming information is to be sent, a prescribed positive potential is applied to the signal electrode 60.

A conveying roller 40, which is made of conductive material, is disposed below the toner passages 31 of the insulating substrate 30. The conveying roller 40 is rotated in a prescribed direction so that a recording sheet 80 is conveyed in the direction shown by arrow A in FIG. 1. A prescribed positive potential is applied to the conveying roller 40.

A toner container 10 containing powder toner is disposed above the insulating substrate 30, and has an opening 11 in the lower part thereof. The opening 11 accommodates the upper part of a toner feed roller 15 which functions as a toner feed means. The toner feed roller 15 which may be a sponge roller faces the line of toner passages 31 formed in the insulating substrate 30. The toner contained in the toner container 10 is continuously fed downward with the rotation of the toner feed roller 15.

The toner container 10 is swingably supported on a support axis 12 which is disposed in parallel with the axis of the toner feed roller 15 upstream in the direction of arrow A with respect to the toner container. A solenoid 91 is disposed on the opposite side with respect to the toner container 10 (downstream in the direction of arrow A). The solenoid 91 is fixed to an appropriate support plate 92 so that a plunger 91*a* of the solenoid 91 moves vertically. The plunger 91*a* is urged upward with a compression spring 91*b*. A lever 13 fixed to the toner container 10 is swingably linked to the upper portion of the plunger 91*a*. Below the lever 13, a positioning portion 14 is formed for positioning the toner container 10 by abutting against the end portion of the support plate 92.

When the solenoid 91 is not electrified, the plunger 91*a* thereof is in the upward stretched state by being urged with the compression spring 91*b*, and thus the toner container is in the state of being swung upward around the support axis 12. As a result, the toner feed roller 15 accommodated in the lower portion of the toner container 10 is apart from the common electrode 50 disposed on the insulating substrate 30. When the solenoid 91 is electrified, the plunger 91*a* moves downward against the compression spring 91*b*, and thereby the toner container 10 is swung downward until the positioning portion 14 thereof abuts against the support plate 92. As a result, the toner feed roller 15 comes into contact with or in close proximity to the common electrode 50.

Next, the operation of the image forming apparatus having the above structure is described. When an image forming operation is not performed, the solenoid 91 is not electrified, thereby the plunger 91*a* is kept in the upward stretched state and the toner container 10 in the upwardly swung state as shown by the two-dot dash lines in FIG. 1. As a result, the toner feed roller 15 in the lower part of the toner container 10 is apart from the common electrode 50, preventing the toner from falling onto the common electrode 50.

When an image forming operation is performed, the solenoid 91 is electrified. Then, the plunger 91*a* moves downward, and thereby the entire body of the toner container 10 is swung downward around the support axis 12. As a result, the toner feed roller 15 is pressed against or in close proximity to the common electrode 50. This allows the toner to be fed onto the common electrode 50.

The toner fed on the common electrode 50 is controlled by an electric field formed between the common electrode 50 and each of the signal electrodes 60 disposed on the bottom surface of the insulating substrate 30 in accordance with an image signal sent to each of the signal electrodes 60 so as to form an image on the recording sheet 80 conveyed by the conveying roller 40.

When non-image forming information is to be sent, the image information generating unit 70 applies negative potential to the corresponding signal electrode 60. In this case, the negatively charged toner fed on the common electrode 50 does not pass through the corresponding toner passage 31. On the other hand, when image forming information is to be sent, the image information generating unit 70 applies positive potential to the signal electrode 60. In this case, an electric field which allows the negatively charged toner to pass through the toner passage 31 is formed therein. In this way, the negatively charged toner particles are attracted toward the signal electrode 50, passing through the corresponding hole 51 of the common electrode 50, the toner passage 31, and the corresponding hole 61 of the signal electrode 60.

Meanwhile, positive potential has been applied to the surface of the conveying roller 40, which faces the signal electrodes 60 via the recording sheet 80. Thus, the negatively charged toner which has passed through the toner passages 31 is attracted to the surface of the conveying roller 40 having the positive potential, and the toner particles attach to the recording sheet 80, resulting in formation of a prescribed toner image on the recording sheet 80.

When the prescribed image is formed on the recording sheet 80, the recording sheet 80 is conveyed to a prescribed fixing device (not shown), where the toner image is fixed on the recording sheet 80.

Example 2

Figure 2:
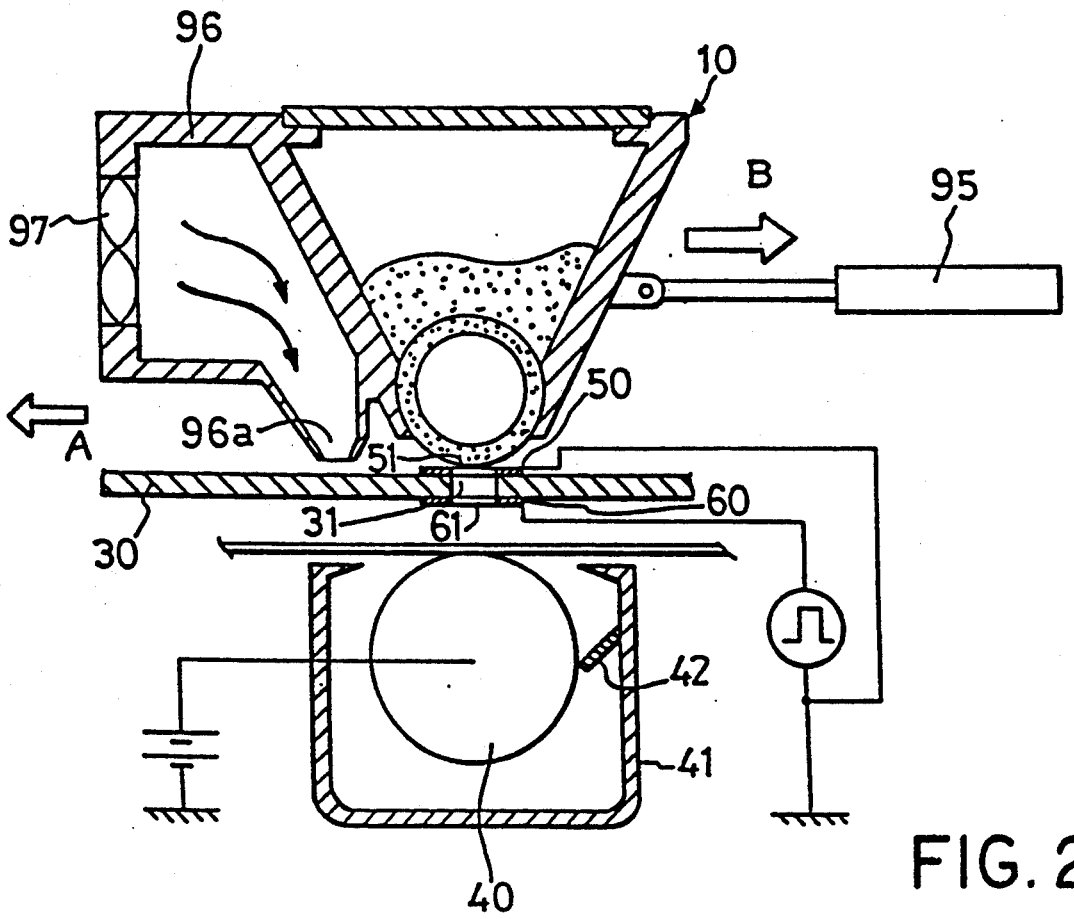
FIG. 2 is a sectional view showing another example of an image forming apparatus according to the present invention.

FIG. 2 shows a second example of an image forming apparatus according to the present invention. In this example, the toner container 10 is disposed movably along the insulating substrate 30. The entire body of the toner container 10 horizontally moves by means of a cylinder 95. An air flow chamber 96 is disposed downstream in the direction of arrow A with respect to the toner container 10. A fan 97 is disposed on the side wall of the air flow chamber to introduce air into the air flow chamber. In the lower portion of the air flow chamber 96 is formed a tapered nozzle section 96*a*, which faces the insulating substrate 30. The air introduced into the air flow chamber 96 by the fan 97 flows inside the air flow chamber 96 and is spurted out from the nozzle section 96*a*. The nozzle section 96*a* faces the toner passages 31 of the insulating substrate 30 when the entire body of the toner container 10 is moved in the direction shown by arrow B in FIG. 2 (the direction opposite to the recording sheet conveying direction).

The conveying roller 40 facing the toner passages 31 of the insulating substrate 30 is held in a casing 41 opened upward. A blade 42 fixed inside the casing 41 slides with the circumferential surface of the conveying roller 40.

Other structures of this image forming apparatus are the same as those of Example 1.

Figure 3:
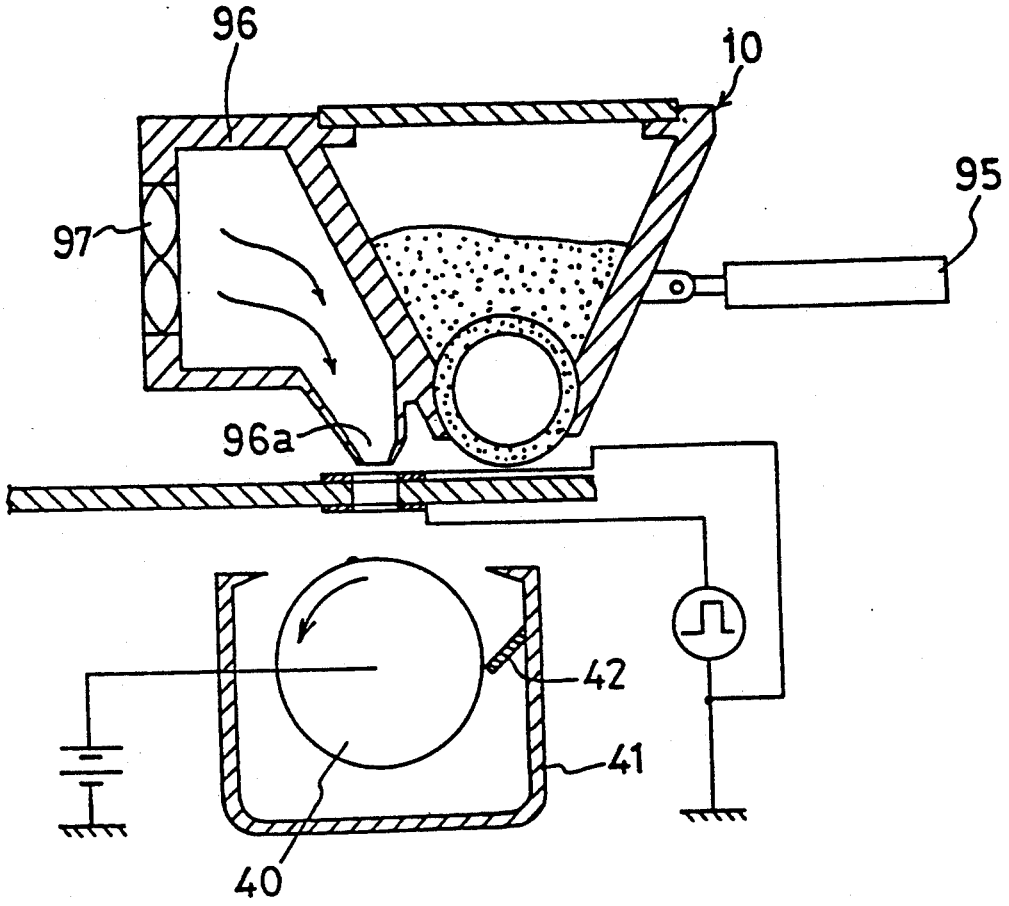
FIG. 3 sectional view illustrating the operation of the image forming apparatus of FIG. 2.

Next, the operation of the image forming apparatus of this example is described. When an image forming operation is not performed, the entire body of the toner container 10 is moved in the direction of arrow B by means of the cylinder 95 until the nozzle section 96*a* of the air flow chamber 96 faces the toner passages 31 of the insulating substrate 30 as shown in FIG. 3. When this position is reached, the fan 97 is driven for a prescribed period of time so that the air is spurted from the nozzle section 96*a* to the toner passages 31. This causes the toner present inside the toner passages 31 to pass therethrough to attach on the circumferential surface of the conveying roller 40 located below the toner passages 31. The toner attached is then wiped off down to the inside of the casing 41 by means of the blade 42 when the conveying roller 40 rotates.

Example 3

Figure 4:
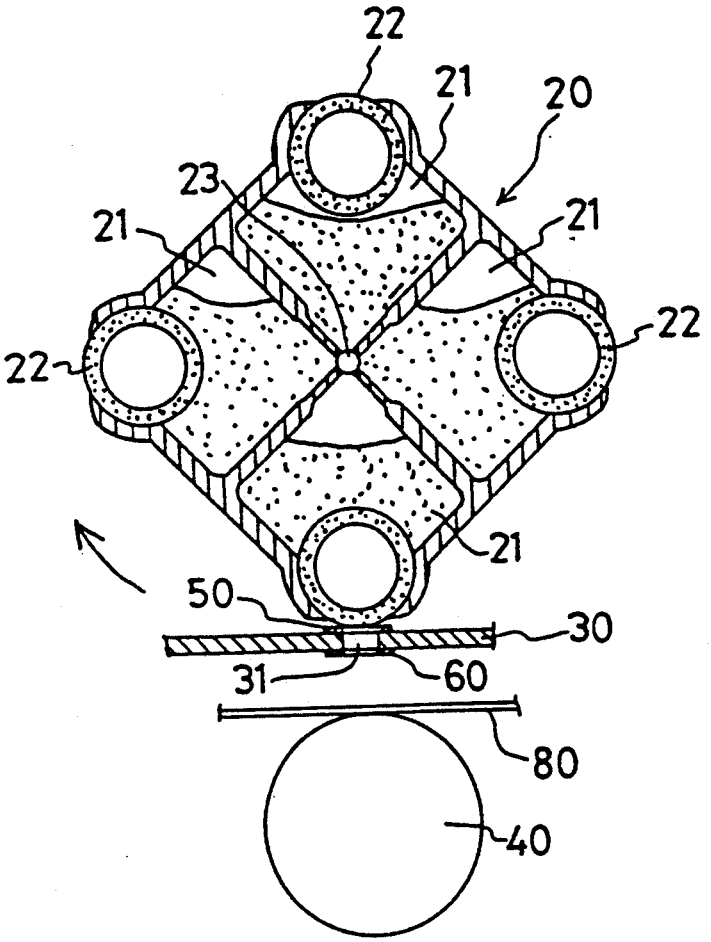
FIG. 4 is a sectional view showing still another example of an image forming apparatus according to the present invention.

Referring to FIG. 4, a third example of an image forming apparatus according to the present invention comprises a toner container 20 having a diamond-shaped section, which is composed of four diamond-shaped toner compartments 21 containing magenta, cyan, yellow, and black toners, respectively. A toner feed roller 22 is rotatably placed in outward facing corner portion of each toner compartment 21.

A support axis 23 is inserted into the core of the toner container 20 and is rotated by a rotating means (not shown). Other structures of this image forming apparatus are the same as those of Example 1.

In the image forming apparatus of the above-described structure, when an image forming operation is performed, either one of the toner feed rollers 22 of the toner compartments 21 comes into contact with or in close proximity to the common electrode 50 on the insulating substrate 30. Which one of the toner feed rollers 22 of the toner compartments 21 comes to face the common electrode 50 depends on a signal sent from the image information generating unit 70. When full color image is to be formed, all of the toner feed rollers 22 successively face the common electrode 50.

When an image forming operation is not performed, the entire body of the toner container 20 is rotated by 45° from the position where either one of the toner feed rollers faces the common electrode 50, so that none of the toner feed rollers face the common electrode 50.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An image forming apparatus comprising:

a substrate having a plurality of toner passages extending therethrough, a pair of electrodes, each having holes extending therethrough and communicating with corresponding toner passages of the substrate, he electrodes sandwiching the substrate as an insulating and being disposed so that each hole of each electrode is aligned with a corresponding toner passage, a toner feed means disposed above one electrode for feeding charged toner, a shifting means for moving the toner feed means toward or away from the toner passages in the substrate, and an image information generating means for giving a prescribed potential between the pair of electrodes so that an electric field which causes the charged toner to pass through the toner passages is formed inside the toner passages.

2. An image forming apparatus according to claim 1, wherein the shifting means moves the toner feed means toward or away from the substrate.

3. An image forming apparatus comprising;

a substrate having a plurality of toner passages extending therethrough, a pair of electrodes, each having holes extending therethrough and communicating with corresponding toner passages of the substrate, the electrodes sandwiching the substrate as an insulation and being disposed so that each hole of each electrode is aligned with a corresponding toner passage, a toner feed means disposed above one electrode for feeding charged toner, a shifting means for moving the toner feed means toward or away from the toner passages in the substrate, and an image information generating means for giving a prescribed potential between the pair of electrodes so that an electric field which causes the charged toner to pass through the toner passages is formed inside the toner passages, and wherein the shifting means moves the toner feed means along the substrate.

4. An image forming apparatus according to claim 3, further comprising a nozzle section which faces the toner passages when the toner feed means is moved away from the toner passages of the substrate by the shifting means, so that air is spurted out from the nozzle section.

5. An image forming apparatus comprising;

a substrate having a plurality of toner passages extending therethrough, a pair of electrodes, each having holes extending therethrough and communicating with corresponding toner passages of the substrate, the electrodes sandwiching the substrate as an insulation and being disposed so that each hole of each electrode is aligned with a corresponding over passage, a toner feed means disposed above one electrode for feeding charged toner, a shifting means for moving the toner feed means toward or away from the toner passages in the substrate, and an image information generating means for giving a prescribed potential between the pair of electrodes so that an electric field which causes the charged toner to pass through the toner passages is formed inside the toner passages, and wherein a plurality of toner feed means are disposed rotatably around a support axis, so that each of the toner feed means faces the toner passages of the substrate as they rotate.

6. An image forming apparatus according to claim 5, wherein four toner feed means are provided for feeding magenta, cyan, yellow, and black toners, respectively.

* * * * *

UNITED STATES PATENT AND TRADEMARK OFFICE

CERTIFICATE OF CORRECTION

PATENT NO. : 5,200,769

DATED : April 6, 1993

INVENTOR(S) : Takemura et al.

It is certified that error appears in the above-indentified patent and that said Letters Patent is hereby corrected as shown below:

IN THE CLAIMS:

Claim 1, column 6, line 68, change "he" to --the--.

Claim 1, column 7, line 1, change "insulating" to --insulation--.

Claim 3, column 8, line 2, delete "and".

Claim 5, column 8, line 19, change "over" to --toner--.

Claim 5, column 8, line 29, delete "and".

Signed and Sealed this

Twenty-ninth Day of March, 1994

*Attest:*

Bruce Lehman

BRUCE LEHMAN

*Attesting Officer*

*Commissioner of Patents and Trademarks*